US005360265A

United States Patent [19]

Cruse

[11] Patent Number: 5,360,265

[45] Date of Patent: Nov. 1, 1994

[54] APPARATUS WITH INVERSION LINKAGE MECHANISM

[76] Inventor: Donald I. Cruse, 9850 - 154 St., Edmondton, Alberta, Canada, T5P 2G6

[21] Appl. No.: 990,740

[22] Filed: Dec. 15, 1992

[51] Int. Cl.[5] ..... B01F 13/00

[52] U.S. Cl. ..... 366/208; 366/219; 74/60

[58] Field of Search ..... 74/60, 61; 366/53, 55, 366/60-63, 208-211, 215-217, 219; 51/163.1, 164.1

[56] References Cited

U.S. PATENT DOCUMENTS

| | | | |
|---|---|---|---|
| 860,155 | 7/1907 | Russell, Jr. | 74/63 |
| 1,071,101 | 8/1913 | Shaffer | 104/23.1 |
| 2,302,804 | 11/1942 | Schatz | 366/209 |
| 3,136,075 | 6/1964 | Brian . | |
| 3,475,976 | 11/1969 | Steinke | 74/63 |
| 3,824,866 | 7/1974 | Schatz | 74/61 |
| 4,341,475 | 7/1982 | Saladin | 366/211 |
| 4,669,225 | 6/1987 | Kuster | 366/219 X |
| 4,957,018 | 9/1990 | Jakubiec et al. | 74/531 |
| 4,992,766 | 2/1991 | Suzuki et al. | 335/223 |

FOREIGN PATENT DOCUMENTS

| | | | |
|---|---|---|---|
| 0249600 | 2/1989 | European Pat. Off. . | |
| 0176749 | 3/1989 | European Pat. Off. . | |
| 2842110 | 4/1980 | Germany | 51/163.1 |
| 2066924A | 7/1981 | United Kingdom . | |
| 643305 | 1/1979 | U.S.S.R. | 51/164.1 |
| 730548 | 4/1980 | U.S.S.R. | 51/164.1 |
| 755577 | 8/1980 | U.S.S.R. | 366/53 |
| 762949 | 9/1980 | U.S.S.R. | 366/219 |
| 780871 | 11/1980 | U.S.S.R. | 366/219 |
| 795958 | 1/1981 | U.S.S.R. | 366/63 |
| 797878 | 1/1981 | U.S.S.R. | 366/63 |
| 818831 | 4/1981 | U.S.S.R. | 51/164.1 |
| 1607922 | 11/1990 | U.S.S.R. | 366/219 |

OTHER PUBLICATIONS

German Patents Abstracts, Sects P Q El General/Mechanical Electrical Derwent Pulic, Aug. 1984.

British Library Science Ref and Information Service Search No. P2771.

On the Synthesis of "Turbula" Gear Train, Wholhart, 8-13 Jul. 1979, pp. 747-750.

Zur Dynamik des Turbula-Mischers, 1986, pp. 164-166.

Brandungswellen abgeschaut, Michael Dorman, 1989, Maschinenmarkt Wurzburg 95.

*Primary Examiner*—David A. Scherbel
*Assistant Examiner*—Charles Cooley
*Attorney, Agent, or Firm*—Herbert Dubno; Yuri Kateshov

[57] ABSTRACT

The apparatus for producing a combination of rotating, tumbling and shaking movements of material in a container has a closed and constrained invertible kinematic link-work of which at least one link serves as receptacle for the container; and motive power for driving the link-work is provided by imparting thrusting power, rather than rotating power.

7 Claims, 5 Drawing Sheets

APPARATUS WITH INVERSION LINKAGE MECHANISM

BACKGROUND OF THE INVENTION

The present invention is concerned with improvements in and relating to apparatus which include an inversion linkage mechanism.

More particularly, the invention is concerned with a method for imparting torque to the input shaft or shafts of an inversion linkage mechanism.

Still more particularly, my present invention relates to a rhythmically-modulated drive arrangement for mixers and/or blenders, of the type generally known as Schatz mixer, as described for example, in U.S. Pat. No. 2,302,804 of Nov. 24, 1942, issued to Paul Schatz, particularly describing an inversion type kinematic link to impart wobbling or wavering motions to a container, for mixing and/or blending the contents of the container; or for use in propulsion mechanisms for ships.

The inversion triple linkage, at times also called the Schatz linkage, is a uniform three-part kinematic chain comprised of rigid links connected by pivots, the axes of two successive links being askew to one another, and which when turned inside out imparts a wobble motion to the center element.

The mechanical principle has been used to advantage in the construction of mixing machines and propulsion mechanisms for ships. The principle requires that the ends of the outer links of the three-part chain are each hinged to a rotating shaft, and that the chain or linkage is then set in motion by imparting a rotary driving force to either one, or both, of these shafts, giving rise in the center link to a unique pattern of motion called "inversion". The phrase "inversion linkage" will therefore be used to denote the Schatz triple linkage in the following.

PRIOR ART

The prior art hitherto has been concerned with systems in which torque is imparted to the shaft or shafts in a manner that does not fully suit the inversion linkage mechanism.

Thus, complex drive systems have been developed to drive such machines/mixers. One known system is using a cumbersome pendulum-type chain drive. Another system uses a universal joint, or joints, set at an angle to act for transfer of motive power between the motor and the linkage mechanism. Also known are dual rotary hydraulic drives for powering two shafts.

U.S. Pat. No. 860,155 of Jul. 16, 1907, to Henry M. Russell, Jr., relates to a mechanical movement including the combination of three aligned revoluble members and a conic link-work differentially connecting said revoluble members.

Russell, Jr. also pertains to a mechanical movement with the combination of three aligned revoluble members, two separate symmetrical, four bar, conic linkages intermediate of two of the said revoluble members, and two gimbal points connecting the two idle pins of the said linkages with the third of the said revoluble members, the linkages being so placed that when the four links of one of the said linkages lie in a plane the four links of the other shall not lie in a plane.

U.S. Pat. No. 1,071,101 of Cleve T. Shaffer issued Aug. 16, 1926, discloses an apparatus, in combination with an aeroplane, with a supporting track therefor, means for propelling the aeroplane relative to said supporting track, flexible connection between said supporting track and said aeroplane, and means for controlling the flexibility of said flexible connection for regulating the universal movement of the aeroplane relative to the supporting track.

Still, in the apparatus according to Shaffer, of the class described, the combination with an aeroplane provided with the usual balancing planes, elevating planes and steering rudder, of means under the control of the passenger within the aeroplane for operating said balancing planes, elevating planes and steering rudder of a supporting track for said aeroplane, means for propelling the aeroplane relative to its supporting track, a flexible connection between the aeroplane and the supporting track, and means under control of a passenger within the aeroplane for controlling said flexible connection for permitting universal movement of the aeroplane during its travel relative to said track.

U.S. Pat. No. 2,302,804 issued Nov. 24, 1942, to Paul Schatz is concerned with a mechanism for producing wavering and rotating movements, comprising: a frame adapted to hold a receptacle, a fork member rotatably secured near one end of the frame, a second fork member rotatably secured near the other end of the frame, the axes of rotation of the fork ends on the frame being at right angles to each other, and a shaft for each fork member to rotate the fork members, said shafts being parallel to each other and at least one of them being a driving shaft for the mechanism. Each shaft can be provided with a fork connection with its respective fork member.

Schatz is further concerned with a device for subjecting wavering and rotating movements to a receptacle, comprising: a frame to removably receive the receptacle, a base member, a pair of shafts spaced to rotate vertically from the base member, a pair of bearings connecting the shafts from the frame, means for rotating one of said shafts, each bearing including two forked members interconnected at right angles to each other of which one forked member is connected to the shaft and the other to the frame.

Schatz also relates to a mechanism for producing wavering and rotating movements, comprising a frame adapted to hold a receptacle, a pair of fork members, one near each end of the frame, the axis of rotation of the fork members on the frame being at right angles to each other, and a second pair of forks each pivotally connected to the mid section of its respective first-mentioned fork member on an axis which is at right angles to said respective first mentioned fork member, each second fork having an extension in the form of a shaft of which both shafts are parallel to each other.

At least one of the shafts is a driving shaft to rotate all the forks and the frame with a wavering motion added to the rotatory motion for the frame.

Schatz also claims a mechanism for producing a combination of rotating, tumbling and shaking movements of a receptacle, comprising a closed and constrained invertible kinematic link-work, of which at least one link serves as receptacle having a supporting device, driving means for the link-work, the receptive link being hinged at both ends to two horse-shoe shaped links, which overlap the receptive link, the axes of the two hinges being at right angles to each other in different planes.

Schatz also claims the mechanism for producing a combination of rotating, tumbling and shaking movements of a receptacle, comprising a closed and constrained invertible kinematic link-work, of which at least one link serves as receptacle having a supporting device, driving means for the link-work, the receptive link being hinged at both ends to two horse-shoe shaped links, which overlap the receptive link, the axes of the two hinges being at right angles to each other in different planes, the two horse-shoe shaped links being hinged in the middle to two fork-shaped members, the axes of the fork-shaped members being at right angles to the axes of the adjoining horse-shoe shaped hinges in different planes.

As well, the mechanism for producing a combination of rotating, tumbling and shaking movements of a receptacle, comprising a closed and constrained invertible kinematic link-work, of which at least one link serves as receptacle having a supporting device, driving means for the link-work, the receptive link being hinged at both ends to two horse-shoe shaped links, which overlap the receptive link, the axes of the two hinges being at right angles to each other in different planes, the two horse-shoe shaped links being hinged in the middle to two fork-shaped members, the axes of the fork-shaped members being at right angles to the axes of the adjoining horse-shoe shaped hinges in different planes, and the two fork-shaped members being inflexibly prolonged into two shafts, which are rotatably mounted in the supporting device so that they are parallel.

As well, the Schatz patent of 1942 refers to the mechanism for producing a combination of rotating, tumbling and shaking movements of a receptacle, comprising [a] a closed and constrained invertible kinematic link-work, of which at least one link [receptive link-]serves as receptacle and having a supporting device, [b] driving means for the link-work, the receptive link being hinged at both ends to [c] two horse-shoe shaped links, which overlap the receptive link, the axes of the two hinges being at right angles to each other in different planes, the two horse-shoe shaped links being hinged in the middle to [d] two fork-shaped members, the axes of the fork-shaped members being at right angles to the axes of the adjoining horse-shoe shaped hinges in different planes, the two fork-shaped members being inflexibly prolonged into two shafts, which are rotatably mounted in the supporting device so that they are parallel, and one of the two rotatably mounted shafts being coupled to [e] a motor by [f] a driving means.

U.S. Pat. No. 3,475,976 of Nov. 4, 1969, to James M. Steinke and assigned to The National Cash Register Company, relates to a transmission device having aligned input and output shafts with yokes on their adjacent ends. The yoke on the input shaft rotatably supports a block having a pin projecting therefrom with the outer end thereof secured to the inner race of a bearing utilized as a support structure. An arcuate link is pivotally joined to said outer end and to one leg of the yoke on said output member. The outer race of said bearing may be adjustably fixed relative to the frame means of the device to provide for a change in the velocity fluctuation of the output shaft.

U.S. Pat. No. 3,824,866 of Jul. 23, 1974, issued to Paul Schatz, refers to an apparatus for generating a wobble motion with a wobble (oloid) body. An endless band is secured to the wobble body for transmitting motion thereto. The endless band is formed of a flat circular ring band which is bent about axes parallel to two perpendicular diameters. In position, the endless band includes a symmetry plane which extends through one of the body suspension means. A drive mechanism secured to a frame imparts motion to the wobble body via the endless band. The wobble body is rotatably secured to said frame by suspension means.

There has remained, however, the need to provide an effective and selective drive system for use with apparatus including an inversion linkage mechanism.

SUMMARY OF THE INVENTION

Included in the objects of my invention are:

To provide an apparatus which is simple in operation and construction.

It is also an object of my invention to provide a drive system that will permit the inversion linkage to be used with a larger number of applications.

It is further an object of the invention to provide a drive system that will permit the inversion linkage to be used with machines having greater capacities.

It is also an object of the present invention to provide a drive system which is more economical than prior art apparatus.

In accordance with one aspect of my invention, there is provided the improvement in an apparatus for producing a combination of rotating, tumbling and shaking movements of material in a container, comprising: (a) a closed and constrained invertible kinematic link-work, of which at least one link serves as said container; and (b) means for driving said link-work, said driving means exerting substantially only thrusting power.

In accordance with a further aspect of my invention, there is provided an apparatus for producing a combination of rotating, tumbling and shaking movements of material in a container, comprising: (a) a closed and constrained invertible kinematic link-work, of which at least one link serves as receptacle for said container; (b) means for securing said container in said receptacle; and (c) rhythmically-modulated driving means for imparting only thrusting rather than rotating power from its source.

In accordance with another aspect of my invention, there is provided a method of imparting rhythmically-modulated movements to an inversion linkage system which is comprised of a closed and constrained invertible kinematic link-work, of which at least one link serves as receptive link for a container, the receptive link being hinged at both ends to two horse-shoe shaped links, which overlap the receptive link, the axes of the two hinges being at right angles to each other in different planes, the two horseshoe shaped links being hinged in the middle to two fork-shaped members, the axes of the fork-shaped members being at right angles to the axes of the adjoining horse-shoe shaped hinges in different planes, the two fork-shaped members being inflexibly prolonged into two shafts, which are rotatably mounted in the supporting device so that they are parallel, both of the two rotatably mounted shafts being coupled to motive power imparting means exerting substantially only thrust, comprising the step of supplying thrusting power such that for every 360° rotation of a respective shaft there are two phases during which a lifting of the receptive link takes place such that the said two horse-shoe shaped links are perpendicular with respect to one another.

DESCRIPTION OF THE DRAWING

Other and further objects and advantages of the invention will become more readily apparent from the following detailed description taken in conjunction with the accompanying drawings in which.

SPECIFIC DESCRIPTION

Alike elements in the following description are identified by like reference designations.

Figure 1:
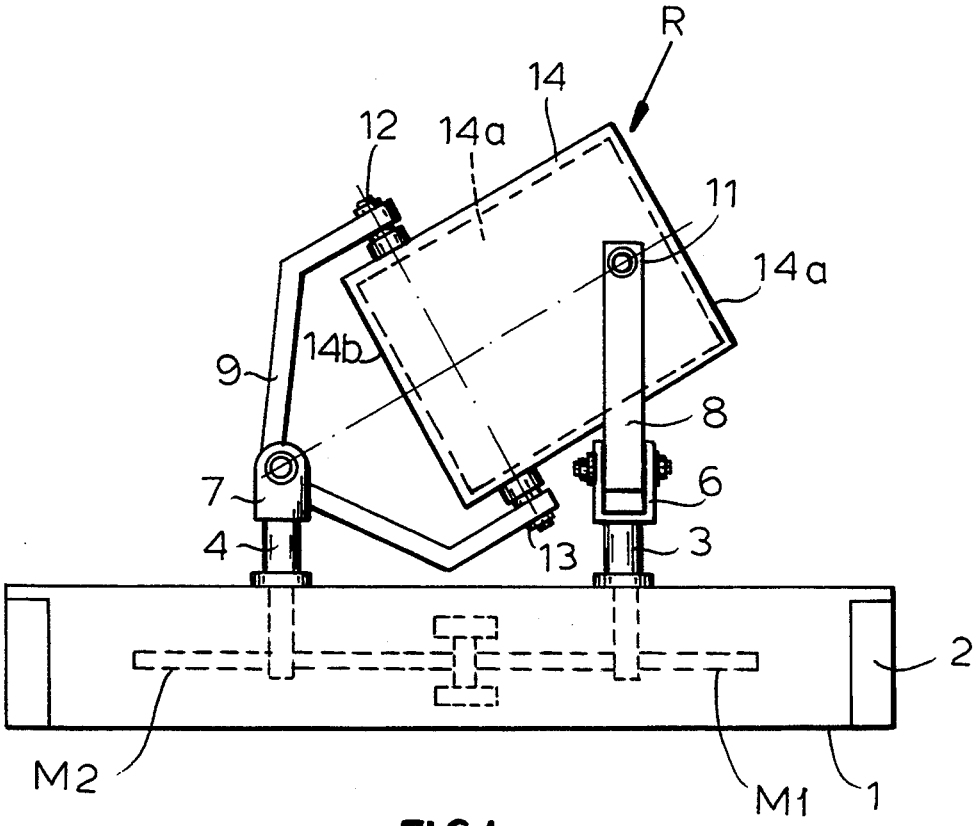
FIG. 1 is a side elevation of a mixer embodiment showing schematically the drive system with vertically disposed shafts with the receptive link being at its highest point or position of the lifting motion.

Turning to FIG. 1, this shows a base 1 from which project vertically disposed shafts 3 and 4, which are suitably journaled in the enclosure 2 of base 1. The drive system contained in base 1 is generally identified by reference designations M1 and M2, and this will be described in greater detail in the following. The torque imparted to shafts 3 and 4 is respectively transmitted to clevises 6 and 7 and thence to yokes 8 and 9 which, in turn, are linked to the receptacle identified by reference designation R. The receptacle R is the center or receptive link 14, of the inversion linkage mechanism I, which has connections 10, 11, 12, and 13.

Usually, the center link 14 serves as the receptacle R for a container 14A diagrammatically shown in FIG. 1. Such container is then in shape so as to fit into the receptacle R. The container may have the configuration of a wobble body as is shown in U.S. Pat. No. 3,824,866 of Paul Schatz, mentioned above.

It will be appreciated that the elements described thus far form a closed and constrained invertible kinematic linkage or link-work, with the receptive center link 14, serving as receptacle R, being respectively hinged at its two ends, **14*a* and 14*b*, by way of the connections 10–13, to a respective one of two horse-shoe or yoke shaped links 8 and 9, which respectively embrace the receptive center link 14. The respective central axes of the two pair of hinges (10, 11) and (12, 13) extend at right angles to each other in different planes, and the two yokes or links 8 and 9 are hinged at their respective mid-points to the clevises 6 and 7, with the axes of these clevises, members or elements, being at right angles to the central axes of the adjoining horse-shoe shaped yokes or links 8 and 9 in different planes, and the clevises or fork-shaped members 5 and 6 being extensions of, or inflexibly prolonged into, the two parallel shafts 3 and 4, which are rotatably mounted in the base or supporting device 1**.

Figure 2:
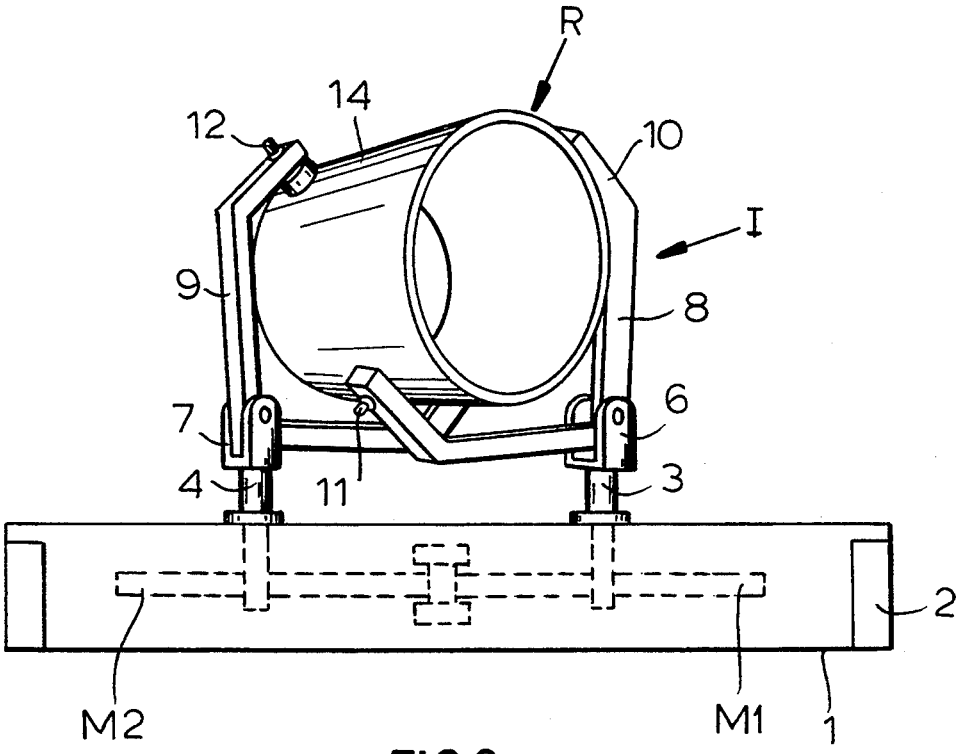
FIG. 2 is a view similar to FIG. 1 with the receptive link shown to be at its mid-point position of the lifting motion.
Figure 9:
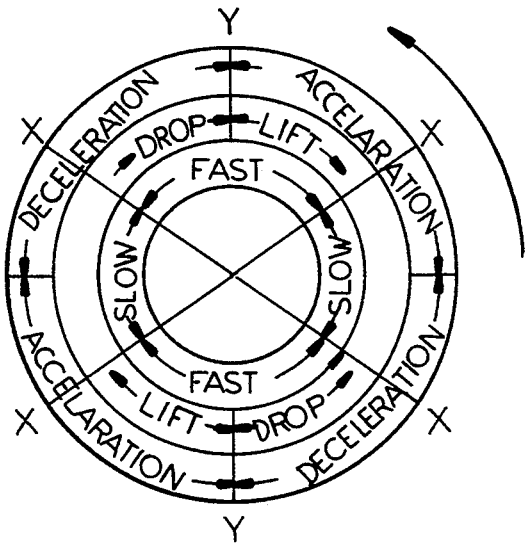
FIGS. 9 and 10, appearing on the sheet with FIGS. 1 and 2, are diagrams showing the various phases for two vertically disposed drive shafts.
Figure 10:
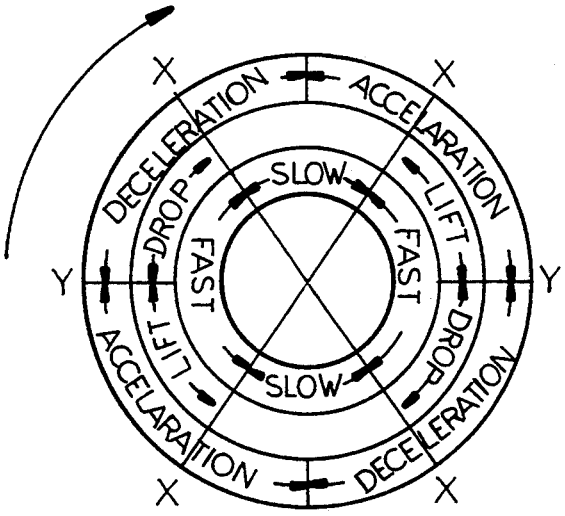

FIGS. 1 and 2, taken together with FIGS. 9 and 10, indicate the operation of the inversion linkage mechanism I with torque being applied to vertically disposed drive shaft 3 and 4.

In every 360° rotation of a respective shaft (3 and 4) there are only two phases, indicated by segments of arc, during which "lifting" of the center link 14 takes place.

With respect to the vertically disposed shafts (3 and 4), "lifting" in this specification refers to the fact that the yokes 8 and 9 are positioned perpendicularly with respect to one another and the right-hand end **14*a* of the center link 14, has been raised from the mid-way point or position in the lifting motion of the inversion linkage mechanism I. The mid-way position is indicated in FIG. 2 and the yokes 8 and 9 are now positioned parallel with respect to one another. The mid-way points are on lines X—X in FIGS. 9 and 10, and the highest point or position of the lifting motion, as is indicated in FIG. 1, are on lines Y—Y in FIGS. 9 and 10**.

In the case of horizontally disposed shafts (3 and 4),the motions are analogous.

During each complete cycle of motion of the center link 14, the end **14*a* is subjected twice to this lifting, i.e., there are two lifting phases for the end 14*a* of the link 14, and two at the other end (14*b*) which is to say, each end (14*a*) and (14*b*) is lifted or elevated twice during each 360° revolution or rotation of each drive shaft (3 and 4). Because the pivot axes of the clevises 6 and 7, at which are connected the centers of the yokes 8 and 9, are disposed at a 90° angle to each other, a total of four lifting phases must occur in each 360° rotation of the center or receptive link 14**.

The lifting phase, when it occurs, occupies approximately a 57.5° segment of arc, but depending upon the payload and other variables, such as friction and smoothness of electrical operation, the driving force itself may be usefully made to persist through 70° of arc, or even slightly more.

Given 70° to be the case, this means that if the driving force is imparted to each shaft (3 and 4) only during the two lift phases, each shaft is driven for a total of only 140° per complete shaft rotation, and this 140° consists of two 70° segments of arc that are diametrically opposite each other, or 180° apart, as is shown in FIG. 9 and 10.

The embodiments of my invention differ from the prior art drive systems in that they accomplish the delivery of a discontinuous drive in alternate manner to each shaft, i.e., not a continuous application of torque to one or more shafts.

"Discontinuous" in the sense used in this specification, therefore, means that during the remaining 220° of rotation of either shaft, substantially no driving force whatever is imparted directly to the respective shaft (3 and 4), but is instead conveyed indirectly, via the motion of the center link 14, from the other shaft.

"Continuous" means that a driving force is applied to one or both shafts, and this is caused to vary in speed so as to accommodate the speed variations of the shaft(s) without special attention being given to the lifting phase.

As mentioned, the drive system embodiments are intended to be used with drive shafts (3 and 4) which are disposed in vertical attitudes, but may also be used with shafts which are otherwise disposed, say horizontally, as described.

Figure 3:
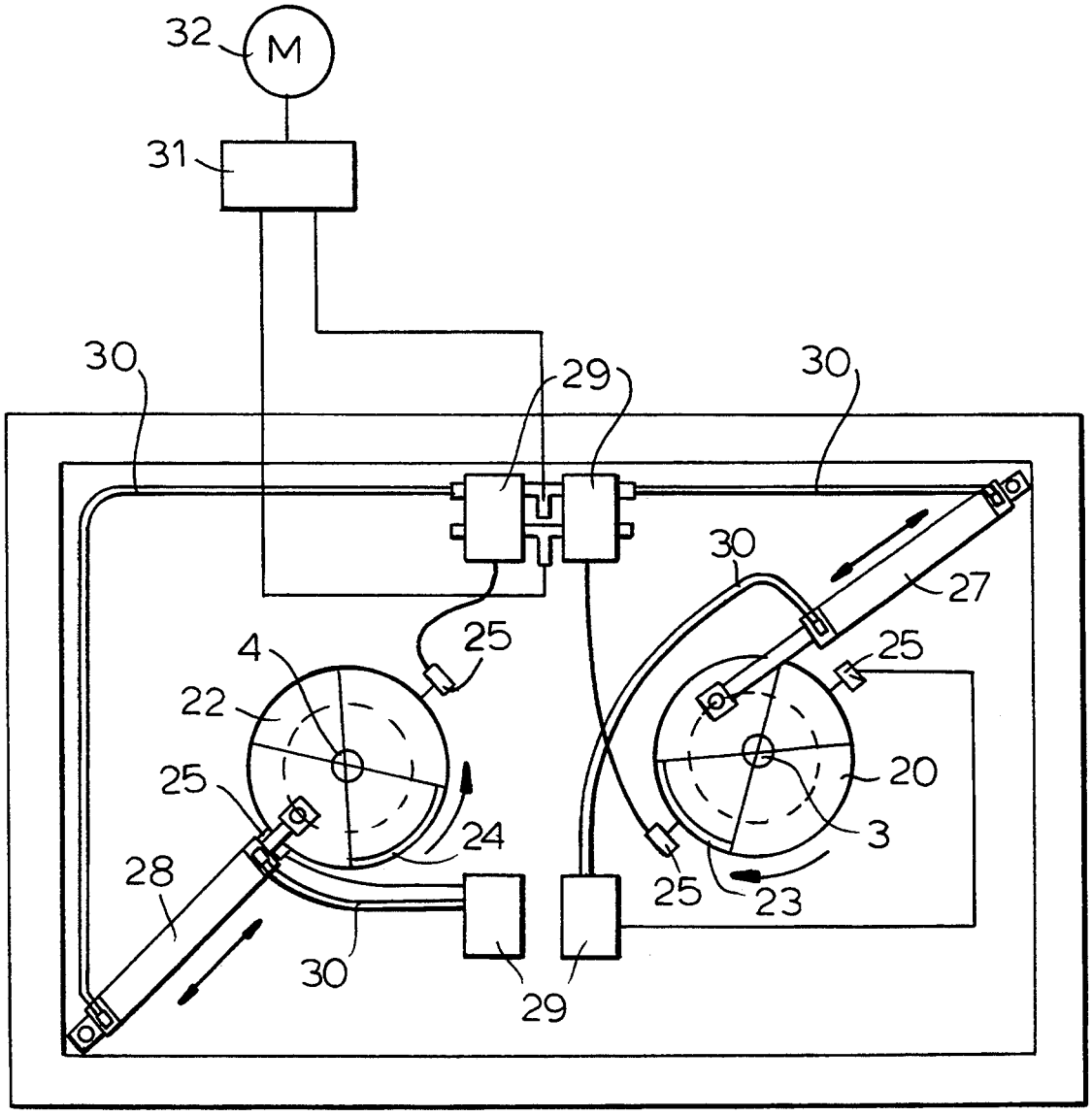
FIG. 3 is a top plan view of a hydraulic drive system embodiment of my invention.

The means to impart motive power to the shafts 3 and 4 will be described next. FIG. 3 shows a pneumatic system, i.e., a system using either a gaseous or fluid medium to power or drive the shafts 3 and 4. For this, the shafts 3 and 4 carry respective armatures which as shown in FIG. 3 are co-planar disks 20 and 22, i.e., the disks 20 and 22 are positioned so as to extend in the same plane, and mounted there at are position indicators 23 and 24 which, in turn, co-operate with position-sensors 25. The position-sensors 25 serve to actuate a pair of piston/cylinder units 27 and 28. These piston/cylinder units 27 and 28 are double-acting units, control led by valves 29 which are arranged in lines 30, and connected to a reservoir 31 with motor 32, as will be readily understood from perusal of FIG. 3.

Figure 4:
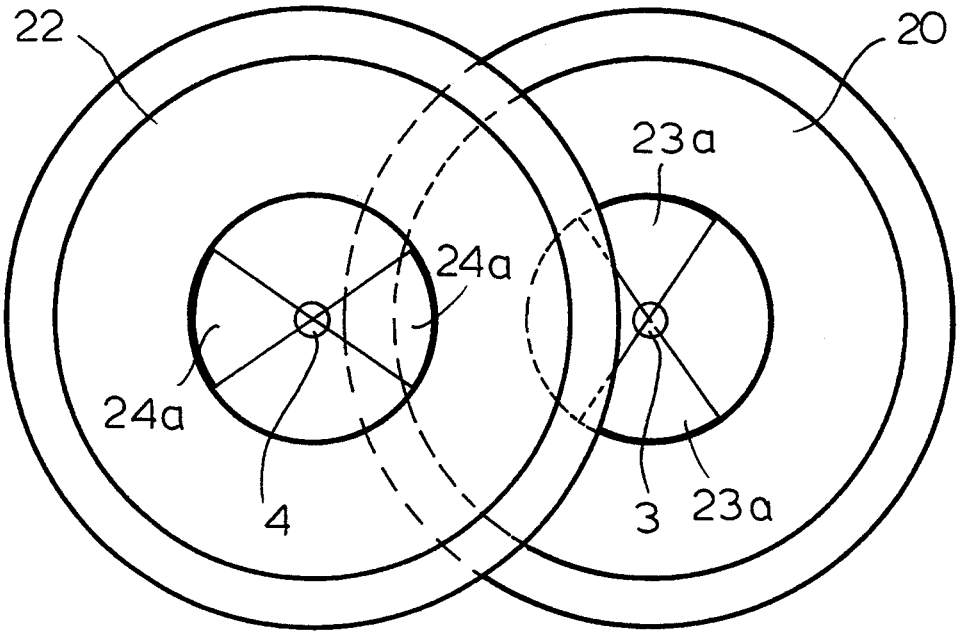
FIG. 4 is a top plan view of a linear induction motor drive system wherein overlapping armature elements are used.
Figure 5:
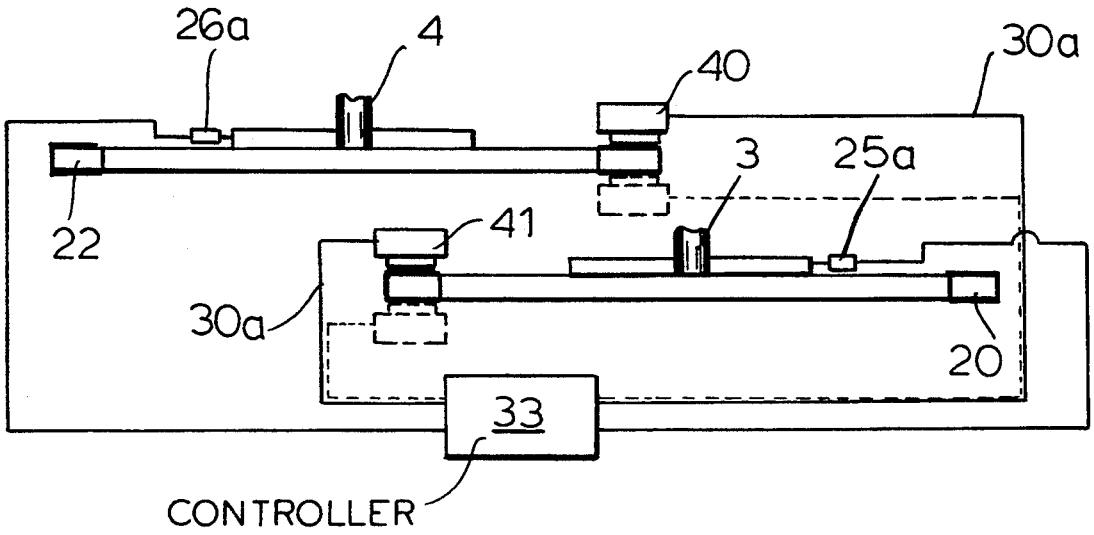
FIG. 5 is the side elevation of the embodiment of FIG. 4.

The drive system embodiment shown in FIGS. 4 and 5 comprises a linear motor system with two linear motors 40 and 41 which cooperate with the magnetic sensors or switches 25*a* and 26*a* and with the position indicators 23*a* and 24*a* of disks 20 and 22 for shafts 3 and 4. The controller 33 can supply AC or DC current to the system. The discs 20 and 22 are respectively mounted on the shafts 3 and 4 to rotate therewith upon actuating of the linear motors 40 and 41 seen in FIG. 5. As is explained previously in reference to FIGS. 9, 10 each of the discs has respective segments corresponding to different speeds and phases. One pair of the segments (in this particular embodiment—small segments) of the discs seen in FIG. 4 correspond to the "lift" portions of the "fast" segments. Sensors 25*a* and 26*a* well known in the art detect the lift phases and generate respective signals received by a controller 33 switching on the respective linear motors 40, 41 which, in turn, compulsory actuate respective shafts 3 and 4 by means of the discs during the "lift" phase. The linear motors are understandably switched selectively off upon completing the respective "lift" phases. The feature of this embodiment resides in the overlapping of portions of the diameters of the armature carrier, i.e., discs 20 and 22, which allows a larger effective diameter, which, in turn, allows a slower angular velocity or speed.

FIG. 5 indicates the arrangement of the elements of FIG. 4 in side elevation.

The embodiment of FIG. 4 need not use sensors (25*a*, 26*a*) and position indicators (23*a*, 24*a*), thereby providing a continuous drive system. In such an embodiment continuous application of power can be used to drive either one shaft, or several shafts.

Figure 6:
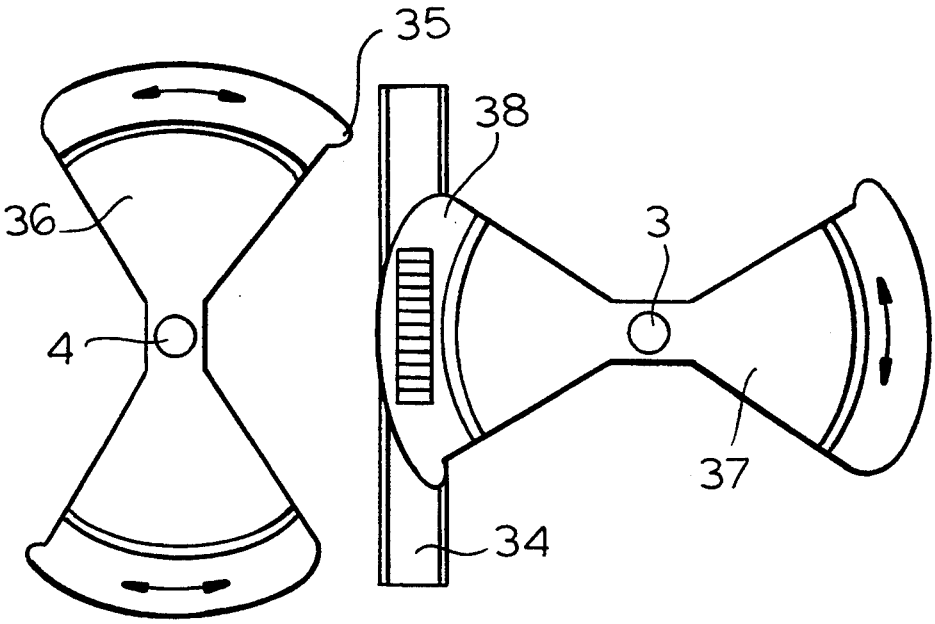
FIG. 6 is a top plan view of a linear induction motor drive system in which the armature paddle elements are located in the same plane.

FIG. 6 shows another type of armature carrier which is paddles rotating with respect to a two-sided linear motor 34 whereby a trailing edge 35 of a paddle 36 is at a variable, pre-determined distance with respect to the leading tip 38 of the other paddle 37. The feature of this embodiment allows the same motor 34 to power both shafts 3 and 4.

Figure 7:
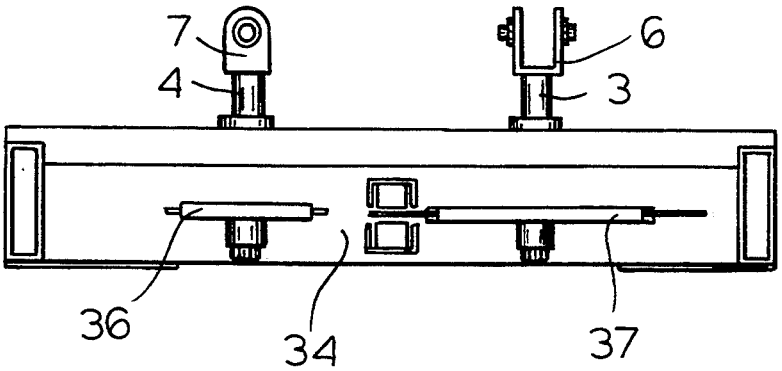
FIG. 7 is the side elevation of the embodiment of FIG. 6.

FIG. 7 indicates the arrangement of the elements of FIG. 6 in side elevation.

Figure 8:
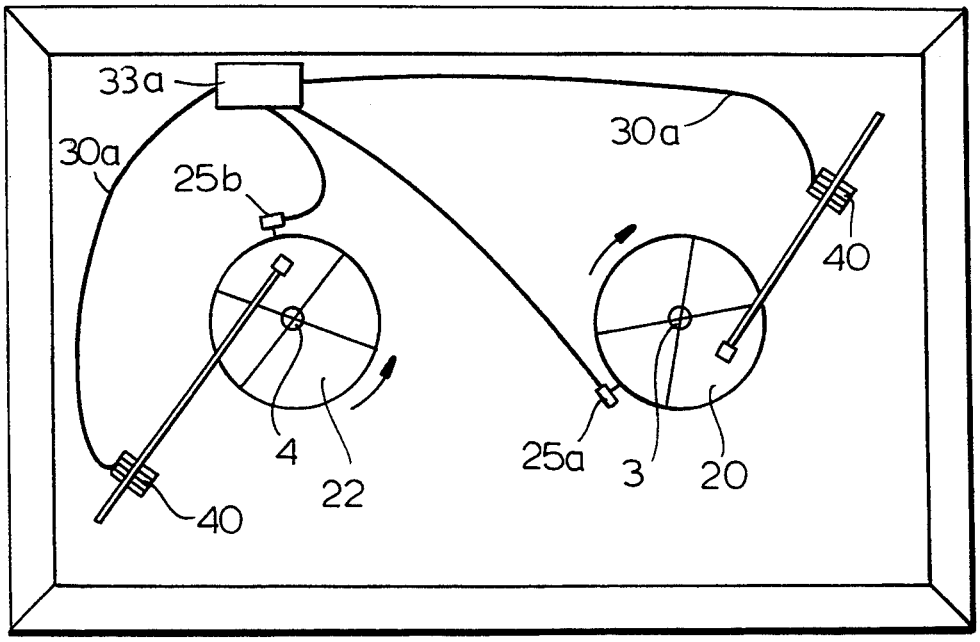
FIG. 8 is a top plan view of a drive system with a linear actuator.

FIG. 8 has the same kinematic scheme as the embodiment shown in FIG. 3 except for the fact that it shows a drive system with two-way linear actuators 40 (AC or DC) with magnetic sensors 25*a* and 25*b* in lines 30*a* are used as opposed to the hydraulic system by the embodiment in FIG. 3. The latter connected to controller 33*a*. Analogously to the case of cylinders 27, 28 shown in FIG. 3, each of the discs 3, 4 also serves as a crankshaft for a respective linear actuators 40. It will be understood that the actuators 40 are mounted so as to allow them to follow the rotating movement of the disks 20 and 22 to which they are respectively connected.

The primary difficulty that has been addressed in my application of the inversion linkage mechanism, particularly in mixer applications, is due to the fact that the geometry of the linkage causes the speed of rotation of the respective drive shafts to be non-linear. Thus, the speed of rotation of each shaft must be altered four times during each 360° rotation. This speed alteration takes the form of a gradual acceleration to a high speed or speed level, followed by a gradual deceleration to a low speed or speed level, both arising in the space of each 180° rotation of a shaft. This pattern is then repeated in each successive 180° rotation of a shaft.

The ratio between the highest speed and the lowest speed is approximately 2:1, and in case of two drive shafts these conditions are always exactly 90° out of phase with each other. This means that when one shaft is at its fastest level or point, the other is always at its slowest level or point.

In some cases both shafts may be driven, and in other cases only one shaft is driven, but in all cases in the prior art the drive is continuously delivered to the shaft, and, by differing methods, made to vary in speed in such a manner that approximately matches the requirements of the inversion linkage of the system.

It will be understood that the embodiments illustrated in the aforesaid are primarily used for describing the present invention, but not as limiting my present invention. Any structure or apparatus made with or without minor modifications but not deviating from the spirit, concept and features of the present invention is deemed as being included in the scope of the claims of my invention.

I claim:

1. An apparatus for imparting rhythmically-modulated movement including rotating, tumbling and shaking movements to material, said apparatus comprising:

a container receiving the material, said container being adapted to be releasably secured to an inversion linkage system, said inversion linkage system including a multi-link, closed and constrained invertible kinematic link-work, with at least one line of said link-work serving as a receptive link for said container, said receptive link having:

a first end and a second end remote from said first end, and hinge means operatively connectible at each one of said first and second ends of said receptive link and extending along respective axes for respectively hinging each end of said receptive link to a respective horse-shoe shaped link, each of said horse-shoe shaped links overlapping said receptive link and the axes of said hinge means being at right angles to each other but in different planes, said horse-shoe shaped links being hinged in the middle to two fork-shaped members having respective axes thereof extending at right angles to respective axes of the adjoining horse-shoe shaped links but in different planes, with said two fork-shaped members being inflexibly prolonged into two parallel and rotatably mounted shafts;

driving means for actuating said shafts, said driving means exerting only thrust and including at least one hydraulic piston/cylinder unit; and sensor means operatively connectible to said driving means for actuation of said at least one hydraulic piston/cylinder unit at the beginning of a pertaining lifting phase in conformity with the rotation of a respective shaft.

2. The apparatus according to claim 1, wherein said container is a wobble body.

3. The apparatus according to claim 1, wherein the thrust is provided by a pair of sequentially operating piston/cylinder units.

4. An apparatus for imparting rhythmically-modulated movement including rotating, tumbling and shaking movements to material, said apparatus comprising:

a container receiving the material, said container being adapted to be releasably secured to an inversion linkage system, said inversion linkage system including a multi-link, closed and constrained invertible kinematic link-work, with at least one link of said link-work serving as a receptive link for said container, said receptive link having:

a first end and a second end remote from said first end, and hinge means operatively connectible at each one of said first and second ends of said receptive link and extending along respective axes for respectively hinging each end of said receptive link to a respective horse-shoe shaped link, each of said horse-shoe shaped links overlapping said receptive link and the axes of said hinge means being at right angles to each other but in different planes, said horse-shoe shaped links being hinged in the middle to two fork-shaped members having respective axes thereof extending at right angles to respective axes of the adjoining horse-shoe shaped links but in different planes, with said two fork-shaped members being inflexibly prolonged into two parallel and rotatably mounted shafts;

driving means for actuating said shafts, said driving means exerting only thrust and including an AC linear induction motor.

5. The apparatus according to claim 4, and further including for each shaft at least one armature carrier and overlapping armature said armature carriers being arranged superposed with respect to one another.

6. The apparatus according to claim 4, and further including, for each one of said rotatably mounted shafts at least one paddle-type armature carrier operatively connected to a pertaining shaft, wherein said linear induction motor powers said at least one paddle-type armature carrier on each of said shaft.

7. An apparatus for imparting rhythmically-modulated movement including rotating, tumbling and shaking movements to material, said apparatus comprising:

a container receiving the material, said container being adapted to be releasably secured to an inversion linkage system, said inversion linkage system including a multi-link, closed and constrained invertible kinematic link-work, with at least one link of said link-work serving as a receptive link for said container, said receptive link having:

a first end and a second end remote from said first end, and hinge means operatively connectible at each one of said first and second ends of said receptive link and extending along respective axes for respectively hinging each end of said receptive link to a respective horse-shoe shaped link, each of said horse-shoe shaped links overlapping said receptive link and the axes of said hinge means being at right angles to each other but in different planes, said horse-shoe shaped links being hinged in the middle to two fork-shaped members having respective axes thereof extending at right angels to respective axes of the adjoining horse-shoe shaped links but in different planes, with said two fork-shaped members being inflexibly prolonged into two parallel and rotatably mounted shafts;

driving means for actuating said shafts, said driving means exerting only thrust and including at least one armature carrier connected with a respective shaft; and means operatively connectible to said driving means for sensing the position of said at least one armature carrier.

* * * * *